US008944433B2

(12) United States Patent
Fehrenbach et al.

(10) Patent No.: US 8,944,433 B2
(45) Date of Patent: Feb. 3, 2015

(54) METHOD FOR HANDLING VALUABLE DOCUMENTS HAVING AN ALIGNING UNIT FOR ALIGNING BANKNOTES AND CHECKS

(75) Inventors: Christian Fehrenbach, Schonach (DE); Hendrik Hoeschen, Paderborn (DE); Udo Petermann, Altenbeken (DE); Paul Freitag, Steinheim (DE); Richard Duesterhus, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/985,807

(22) PCT Filed: Feb. 15, 2012

(86) PCT No.: PCT/EP2012/052589

§ 371 (c)(1),
(2), (4) Date: Sep. 9, 2013

(87) PCT Pub. No.: WO2012/110556

PCT Pub. Date: Aug. 23, 2012

(65) Prior Publication Data

US 2013/0334770 A1 Dec. 19, 2013

(30) Foreign Application Priority Data

Feb. 17, 2011 (DE) ..... 10 2011 000 783

(51) Int. Cl.
*B65H 9/16* (2006.01)
*B65H 9/00* (2006.01)
(Continued)

(52) U.S. Cl.
CPC ..... *B65H 9/00* (2013.01); *B65H 5/062* (2013.01); *B65H 9/166* (2013.01); *G07D 7/00* (2013.01);
(Continued)

(58) Field of Classification Search
USPC ..... 271/228, 251; 194/206, 207; 209/534; 382/135; 902/8–17
See application file for complete search history.

(56) References Cited

U.S. PATENT DOCUMENTS 7,090,121 B2 8/2006 Wanibe et al.
7,950,518 B2 5/2011 Fehrenbach et al.
(Continued)

FOREIGN PATENT DOCUMENTS

DE 10203177 C1 7/2003
DE 10-2007-025940 A1 12/2008
(Continued)

OTHER PUBLICATIONS

International Preliminary Report on Patentability for PCT/EP2012/052589 mailed Aug. 29, 2013 with English translation (14 pages).
(Continued)

*Primary Examiner* — Gerald McClain
(74) *Attorney, Agent, or Firm* — Harness, Dickey & Pierce, P.L.C.

(57) ABSTRACT

A device for handling notes of value including a transport unit for transport of the notes of value in a transport direction along a transport path, and an aligning unit for alignment of the notes of value. The device further includes a sensor arranged upstream of the aligning unit for determining at least one feature of the notes of value, and a control unit that controls the aligning unit such that the aligning unit aligns each note of value depending on the determined expression of the feature of the note of value in a preset first target alignment or at least in a preset second target alignment that is different from the first target alignment.

15 Claims, 16 Drawing Sheets

(51) Int. Cl.

| | |
|---|---|
| ***B65H 5/06*** | (2006.01) |
| ***G07D 7/00*** | (2006.01) |
| ***G07D 11/00*** | (2006.01) |

(52) U.S. Cl.

CPC ..... *G07D 11/0021* (2013.01); *G07D 11/0084* (2013.01); *B65H 2404/6111* (2013.01); *B65H 2511/20* (2013.01); *B65H 2511/416* (2013.01); *B65H 2701/1912* (2013.01); *Y10S 902/17* (2013.01)

USPC ..... 271/251; 271/228; 194/206; 382/135; 902/17

(56) References Cited

U.S. PATENT DOCUMENTS

| | | | |
|---|---|---|---|
| 7,954,816 | B2 | 6/2011 | Freitag et al. |
| 8,340,391 | B2 | 12/2012 | Petermann |
| 2008/0073824 | A1 | 3/2008 | Watanabe et al. |
| 2010/0126827 | A1 | 5/2010 | Fehrenbach et al. |
| 2010/0213023 | A1 | 8/2010 | Freitag et al. |
| 2010/0310148 | A1 | 12/2010 | Petermann |
| 2012/0211935 | A1 | 8/2012 | Petermann et al. |
| 2012/0282073 | A1 | 11/2012 | Fehrenbach |
| 2013/0099439 | A1 | 4/2013 | Duesterhus |
| 2013/0126311 | A1 | 5/2013 | Fehrenbach |

FOREIGN PATENT DOCUMENTS

| | | | |
|---|---|---|---|
| DE | 10-2007-059410 | A1 | 6/2009 |
| DE | 10-2008-050524 | A1 | 4/2010 |
| EP | 1637487 | A2 | 3/2006 |
| WO | WO-2010-079094 | A1 | 7/2010 |

OTHER PUBLICATIONS

English Translation of the Written Opinion of the ISA for PCT/EP2012/052589, mailed May 14, 2012; ISA/EP.

METHOD FOR HANDLING VALUABLE DOCUMENTS HAVING AN ALIGNING UNIT FOR ALIGNING BANKNOTES AND CHECKS

CROSS-REFERENCE TO RELATED APPLICATIONS

This application is a National Stage of International Application No. PCT/EP2012/052589, filed Feb. 15, 2012, and published in German as WO 2012/110556 A1 on Aug. 23, 2012. This application claims the benefit and priority of German Application No. 10 2011 000 783.0, filed Feb. 17, 2011. The entire disclosures of the above applications are incorporated herein by reference.

BACKGROUND

This section provides background information related to the present disclosure which is not necessarily prior art.

TECHNICAL FIELD

The invention relates to a device for handling notes of value comprising a transport unit for transport of the notes of value in a transport direction along a transport path and an aligning unit for aligning the notes of value. Further, the device comprises a control unit for control of the aligning unit.

DISCUSSION

From document DE 102 03 177 C1 a device for aligning notes is known wherein the notes to be aligned are transported by means of at least one aligning element against a guiding edge directed in transport direction. The problem with such a device is that thus all notes are inevitably aligned in the same alignment. This is especially problematic if the aligning unit is used in a device for handling notes of value in which both checks and banknotes can be processed. For a safe transport of the checks and the banknotes and/or for reading the banknotes and the checks it is necessary that the checks and banknotes are aligned with different alignments. Otherwise, a jamming of the notes of value and/or a faulty reading of the checks and/or banknotes may occur.

From document DE 10 2007 059 410 A1 a reading unit for reading a MICR section of a check is known.

SUMMARY OF THE INVENTION

It is an object of the invention to provide a device for handling notes of value by means of which notes of value of different kinds of notes of value can be handled in a reliable manner.

By means of providing a sensor that is arranged upstream to the aligning unit for determining at least one feature of the notes of value and by means of aligning the notes of value depending on the expression of the at least one determined feature in a preset first target alignment or at least one preset second target alignment that is different from the first target alignment it is achieved that the different notes of value are each aligned in an alignment that is optimal for them, so that the notes of value can be processed further reliably. By this, it is especially achieved that the notes of value are supplied to a sensor unit that is arranged downstream of the alignment unit in such a manner that the sensor unit can reliably read out information printed onto the notes of value, such as the denomination and/or magnetic information of a MICR section. Further, by means of the respective alignment in the optimal target alignment it is achieved that a probable jamming of the notes of value, in particular a jamming with transport elements that are arranged laterally to the transport path is avoided or at least reduced.

The sensor determines as a feature of the notes of value in particular the type of the note of value, the size of the note of value and/or the alignment of the note of value. For determining the size of the notes of value in particular the dimensions of the note of value, i.e. the length of the longer lateral edges and the length of the shorter lateral edges are determined. By alignment of a note of value it is in particular meant the relative position of a note of value relative to the transport direction and here in particular relative to an edge of the transport plane directed in transport direction in which the notes of value are transported. The alignment of the note of value is in particular determined via the angle about which the note of value is rotated to the transport direction and/or via the eccentricity of the note of value relative to the center axis of the transport path.

As expressions for the feature of the type of note of value a difference is in particular made between checks and banknotes. In case of banknotes a further distinction can be made into banknotes with different denominations.

The aligning unit aligns a note of value preferably in the first target alignment, if as expression it was determined that the note of value is a check. If it was however determined that the note of value is a banknote, it is aligned in the second target alignment. Here, the target alignment is preset such that a check aligned in it can be read by a sensor unit, in particular a MICR reader and such that a jamming of the check during transport within the device is avoided. Consequently, the second target alignment is preset such that a banknote that is aligned in the second target alignment will be detected reliably by the sensors of an authenticity check unit, so that it can be guaranteed that the authenticity of the note of value and/or the denomination of the note of value can be determined reliably. Further, the second target alignment is also preset such that a banknote transported in this alignment can be transported safely, so that a jamming of notes of value during transport will be avoided.

In an alternative embodiment of the invention the aligning unit can align the note of value, if the note of value is a banknote, also depending on the determined size of the note of value in the second target alignment or in at least one further preset target alignment. In this embodiment in particular for each size of the note of value and thus for each possible denomination to be processed a target alignment is preset in which the notes of value of this denomination can be transported most reliably and in which the sensors of the authenticity check unit can reliably detect the features required for the authenticity check of the banknote.

It is advantageous if at first the aligning unit aligns all notes of value in the first target alignment, and if the aligning unit leaves a note of value, in each case depending on the determined expression of the feature of a note of value, in the first target alignment and transports it further in transport direction without a change in the alignment in the first target alignment or aligns the note of value from the first target alignment to the at least one second target alignment. By means of aligning all notes of value firstly in the first target alignment it is achieved that, independent of the actual alignment a note of value has when being supplied to the aligning unit, at first all notes of value are brought into a uniform first target alignment. From this uniform first target alignment those notes of value that are to be aligned in the second target alignment can then be brought in the second target alignment requiring only little effort and only few aligning elements.

Notes of value that are to be aligned in the first target alignment in any event may remain in this, so that no further change in the alignment of these notes of value is necessary.

The first target alignment is in particular preset such that the longer sides of a note of value that is aligned in the first target alignment are directed parallel to the transport direction. In the same way, the second target alignment can be preset such that the longer sides of a note of value that is aligned in the second target alignment are directed parallel to the transport direction. In this case both the notes of value that are transported in the first target alignment and the notes of value that are transported in the second target alignment are transported short-side-first, i.e. with one of their short sides first. The first target alignment and the second target alignment differ only in the relative position of the longer sides of the notes of value to the center axis of the transport path along which the note of value are transported.

In a further alternative embodiment of the invention the second target alignment is preset such that a note of value that is transported in it is arranged such that its longer longitudinal axis coincides with the center axis of the transport path.

The aligning unit comprises in particular a permanently driven first transport element that is directed in transport direction. Via this first transport element all notes of value supplied to the aligning unit are transported in transport direction independent of the determined expression of the feature. In an especially preferred embodiment in an initial part of the aligning unit viewed in transport direction at least one of such permanently driven transport elements directed in transport direction is arranged, and in a final part of the aligning unit viewed in transport direction also at least one of such permanently driven transport elements directed in transport direction is arranged. Via these transport elements it is achieved that a note of value being supplied to the aligning unit is reliably transported further in transport direction within this aligning unit, so that the occurrence of a jamming of notes of value is avoided.

The aligning unit comprises preferably at least one second transport element directed in transport direction that in an activated operating mode contacts a note of value to be aligned and changes the alignment and/or position of the note of value and that in a deactivated mode does not change the alignment and position of the note of value to be aligned. By a transport element directed in transport direction it is in particularly meant that the force exerted on the note of value by this transport element is directed in transport direction.

By the alignment, as has already been described, the relative position of the note of value to the transport direction and to a center axis of the transport path is meant; whereas the position indicates the precise location at which a note of value is arranged within the transport path. Thus, a note of value can be changed in its position without changing its alignment. This is the case if a note of value is transported exactly in transport direction without the note of value being shifted transversally to the transport direction and without being rotated. In this case the note of value keeps its alignment and changes only its position within the transport path.

The control unit determines in particular the operating mode of the second transport element depending on a determined actual alignment and/or actual position of the note of value to be aligned. The actual alignment and/or the actual position can be determined via the sensor by means of which also the feature is determined and/or can be detected via a further sensor. Via controlling the operating mode between the activated and the deactivated operating mode the aligning unit changes the alignment and/or position of the note of value depending on the actual alignment or respectively actual position, so that the note of value is brought from its actual alignment and actual position in the first target alignment or the second target alignment or converges at least one of the two target alignments. For this, the control unit determines, depending on the determined actual alignment and/or actual position, in particular the point in time at which the second transport element is restored from the deactivated operating mode to the activated operating mode and/or the length of time during which the second transport element is operated in the activated operating mode.

Further, the alignment unit can comprise at least one third transport element directed angularly to the transport direction that in an activated operating mode contacts the note of value to be aligned and changes the alignment and/or position of this note of value and that in an deactivated operating mode neither changes the alignment nor the position of the note of value. The control unit determines, depending on the determined actual alignment and/or actual position of the note of value to be aligned, the operating mode of the third transport element. Analogous to the second transport element the control unit also determines for the third transport element preferably the point in time and/or the length of time at which it is activated and during which it remains activated. Thus, the alignment and the position, in particular via interaction between the second and third transport element are changed and consequently the note of value is brought in the first target alignment or the second target alignment.

The third transport element is preferably arranged and/or aligned such that in the activated operating mode it transports and/or rotates the note of value to be aligned in direction of a partition element. The control unit controls the third transport element and the second transport element such that these transport the note of value to be aligned such that it is aligned in the first target alignment in which it rests with one of its longer sides against a contact area of the partition element that is directed parallel to the transport direction. Via this partition element the target alignment can be determined easily, so that a note of value to be aligned in it can easily brought in this first target alignment. The partition element is preferably arranged such that it laterally limits the transport path at one side.

In particular the partition element has a concave shape, so that it is achieved that the note of value to be aligned is guided transversely to the transport plane in which the note of value is transported. Preferably the partition element has a C-profile. By this it is especially avoided that a note of value that is transported against the partition element is transported over or respectively under the partition element leading to the first target alignment no longer existing.

Further, it is advantageous if the aligning unit comprises at least one fourth transport element that is arranged in transport direction downstream of the third transport element that in a activated operating mode contacts the note of value to be aligned and changes the alignment and/or the position of the note of value, and in a deactivated operating mode neither changes the alignment nor the position of the note of value to be aligned. Further, the aligning unit comprises in particular fifth transport element that is arranged downstream of the third transport element and angularly to the transport direction and is facing away from the partition element that in an activated operating mode contacts a note of value to be aligned and transports it away from the partition element, and that in a deactivated operating mode changes neither the alignment nor the position of the note of value to be aligned. Depending on the target alignment intended for the note of value the control unit determines the operating modes of the fourth and/or fifth transport element. In particular, the control unit determines in each case the point in time at which the fourth transport element and the fifth transport element are to be switched from the deactivated to the activated operating mode, and the length of time during which the fourth and the fifth transport elements are each to be operated in the activated operating mode.

After determining the first target alignment for a note of value, the control unit operates the fourth transport element in the activated operating mode and the fifth transport element in the deactivated mode. By this, it is achieved that the note of value remains in the first target alignment and is transported in transport direction without changing its alignment.

However, if for the note of value the second target alignment has been determined, the control unit activates the fifth transport element, so that this transports the note of value away from the partition element from the first target alignment to the second target alignment. Here, at the same time the fourth transport element can be activated, so that the note of value is transported together by both transport elements while it is to be brought from the first target alignment to the second target alignment.

The first target alignment can in particular be preset such that a note of value aligned in this first target alignment contacts the partition element, whereas the longer side of a note of value aligned in the second target alignment facing the partition element has a preset distance to the partition element. In particular, additionally further target alignments can be preset, wherein the further target alignments differ by the preset distance to the partition element. Depending on the determined size of the note of value the notes of value are aligned in the different target alignments, wherein the notes of value are in particular aligned such that the distance of the longer side facing the partition element in the respective preset target alignment is the greater, the smaller the width of the note of value, i.e. the length of its shorter side, is.

The second, the third, the fourth and/or the fifth transport element are each preferably provided with at least one pair of rollers comprising two rollers, wherein at least one roller is movably transversely or angularly to the transport plane in which the notes of value are transported. Via movement of this roller transverse or angular to the transport plane the corresponding transport element is set between the activated and the deactivated operating mode. In the activated operating mode both rollers of the pair of rollers are arranged as close to each other that they exert a force on a note of value arranged between them via which the note of value is transported in the running direction of the rollers, so that depending on each alignment of the rollers also the alignment of the note of value can be changed. In the deactivated operating mode however, the distance of the rollers to each other is as large that they do not exert a force on the note of value arranged between the rollers that is great enough to transport the note of value in running direction of the rollers.

At least one of the rollers of each pair of rollers is permanently driven by means of a drive unit, in particular by means of a central drive unit of the device. By changing the distance of the rollers to each other the adjustment of the operating modes of the respective transport elements can be performed easily despite the permanent drive. The movement of the rollers is in particular performed by means of solenoids.

In a preferred embodiment the aligning unit is provided with at least one first sensor for determining the actual alignment and/or the actual position of a note of value supplied to the aligning unit. Additionally or alternatively, the device is in particular provided with a second sensor for determining the actual alignment of a note of value during the alignment procedure and/or at least with a third sensor for determining the actual alignment and/or the actual position of a note of value after the alignment procedure. By means of the first sensor the information required for the control of the transport elements can be obtained, so that the transport elements are controlled such that the note of value is moved from its actual alignment to the target alignment. By means of the second sensor a monitoring of the alignment procedure is possible, so that, if the alignment procedure is not performed orderly, the control of the transport elements can be changed, so that the note of value is actually aligned in the target alignment intended for it. By means of the third sensor in particular a closed-loop control can be formed that, depending on the actual alignment of the note of value after passing through the aligning station via a comparison with the preset target alignment, changes the control of the transport elements such that if there is a deviation between the actual alignment after passing through the aligning unit and the preset target alignment, this will be reduced or compensated in case of further notes of value to be aligned by the aligning unit.

By an alignment procedure the moving of a note of value from its actual alignment to its intended preset target alignment is understood.

The first sensor, the second sensor and/or the third sensor preferably each comprise at least one light barrier by means of which the position and/or alignment of the note of value can be easily determined. In an alternative embodiment of the invention, the first sensor, the second sensor and/or the third sensor can each also comprise a camera via which a picture with an imaging of the note value is determined. By means of an image processing algorithm stored in the control unit the control unit determines the alignment and/or position of the note of value from the picture.

In particular, the device is designed such that the transport path along which the notes of value are transported within the aligning unit is designed such that the notes of value are diverted by a preset angle. This angle has in particular a value in the range between 170° and 190°, preferably of approximately 180°. By this, an especially compact design of the aligning unit is achieved, so that only little space is required for it. The transport path is in particular formed by two flat partition elements, wherein the note of value to be aligned rests on one of these partition elements and is limited by the other partition element at the opposite side.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
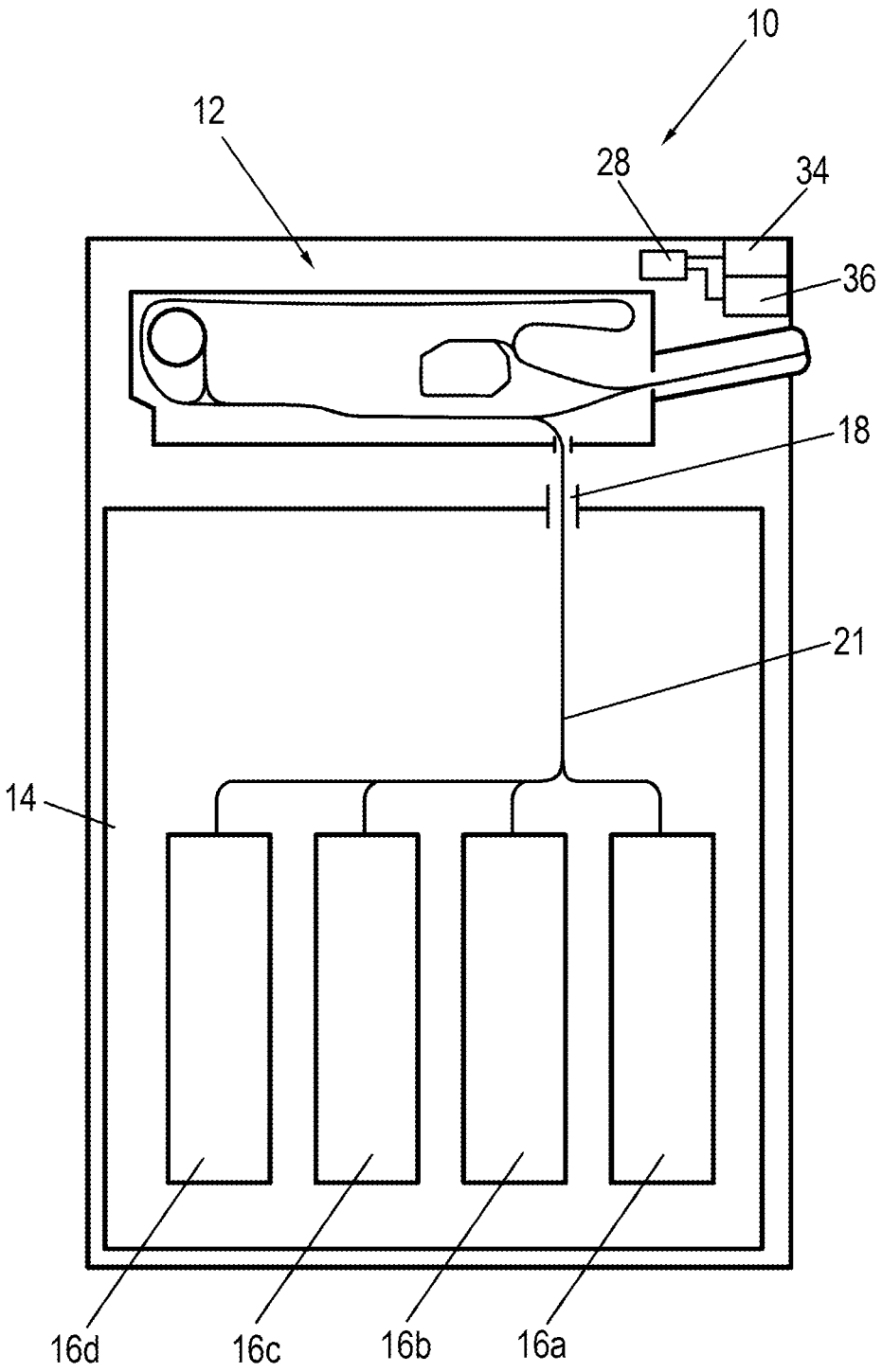
FIG. 1 is a schematic illustration of a device for handling notes of value.

FIG. 1 shows a schematic illustration of a device 10 for handling notes of value. The device 10 is in particular an automatic cash safe, an automatic cash register system and/or an automated teller machine, such as a cash deposit machine for depositing banknotes and checks.

The device 10 comprises a head module 12 and a safe 14. The design of the head module 12 is described in more detail in connection with FIG. 2. In the safe 14 four value note cassettes 16*a* to 16*d* are arranged in which the notes of value can be received. Here, in particular one of the value note cassettes 16*a* to 16*d* is provided for receiving checks, and the other three value note cassettes 16*a* to 16*d* for receiving banknotes. The banknotes are received in particular in one single denomination, i.e. in each value note cassette 16*a* to 16*d* always only banknotes of one denomination are received. Alternatively, the notes of value can be stored in mixed denominations, i.e. in one value note cassette 16*a* to 16*d* notes of value of different denominations are received. In an alternative embodiment in the safe 14 more than four or less than four, in particular two, value note cassettes 16*a* to 16*d* can be provided. In particular, a so-called reject cassette can be provided in which notes of value are received that are suspected as counterfeit and/or that are damaged. In a preferred embodiment of the invention two value note cassettes 16*a* to 16*d* are provided, namely one for receiving checks and one for receiving banknotes.

Here, the notes of value can be received in the value note cassettes 16*a* to 16*d* in stacked form in a receiving area and can also be stored wound up between two foil tapes on a drum module. Within the safe 14 also different types of value note cassettes can be used.

In the present embodiment the device 10 is designed as a mere cash deposit device in which notes of value can only be received. Alternatively, it can also be designed as a cash recycling machine in which notes of value can be deposited and be withdrawn.

The safe 14 is provided with a transfer slot 18 through which the notes of value are supplied from the head module 12 to the safe 14. From the transfer slot 18 the notes of value are transported via a transport unit identified with the reference sign 21 to the value note cassettes 16*a* to 16*d*.

Figure 2:
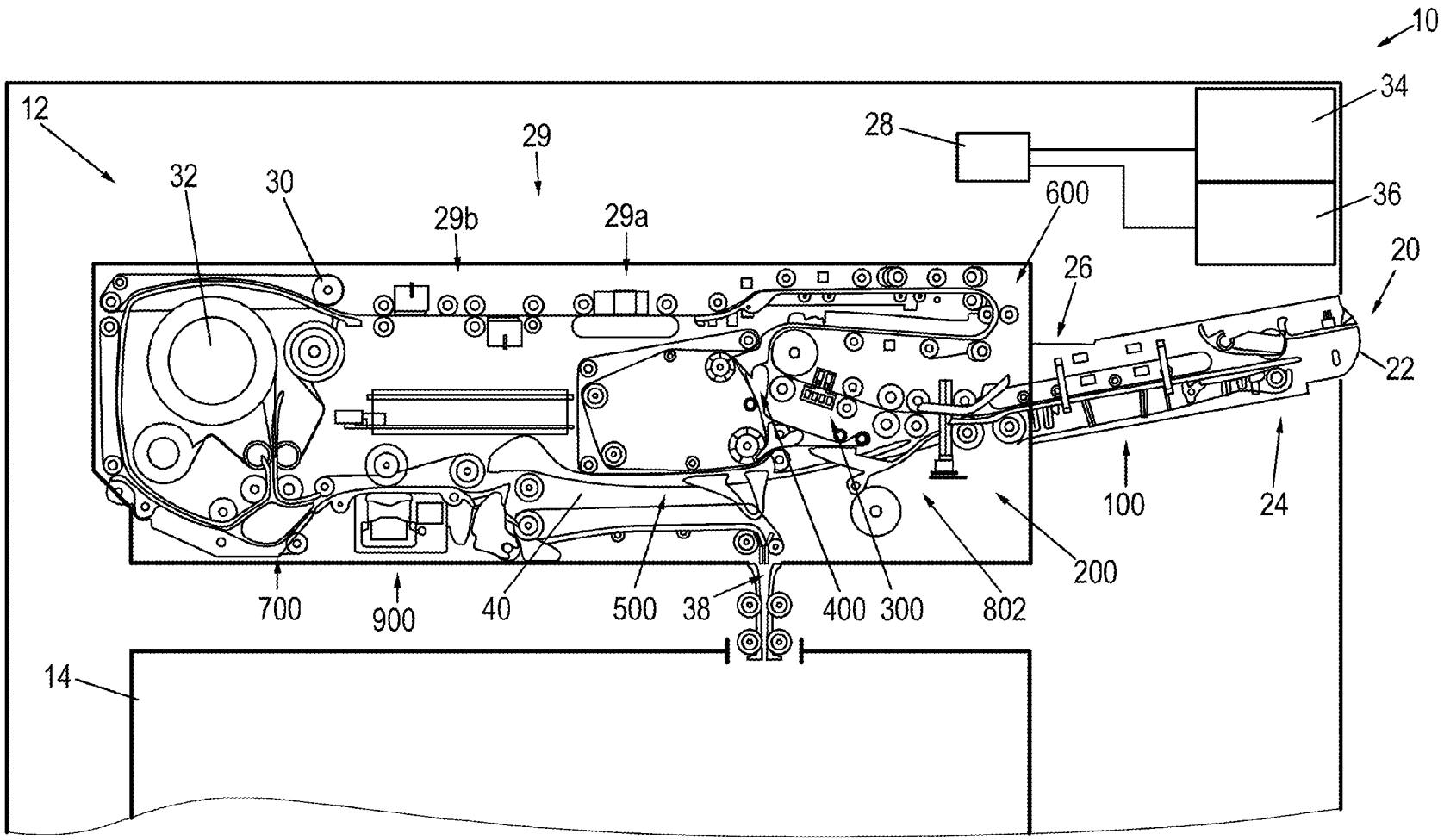
FIG. 2 is a schematic illustration of a head module of the device according to FIG. 1.

FIG. 2 is a schematic illustration of the head module 12 according to FIG. 1. The head module is provided with an input and output unit 20, via which the notes of value can be entered in form of a stack of notes of values. Further, via this input and output unit 20 single notes of value and/or stacks of notes of value can be dispensed to the user of the device 10. The input and output unit 20 is in particular provided with a so-called shutter 22 via which an opening for depositing and dispensing of the notes of value can be opened and closed.

A stack of notes of value deposited via the input and output unit 20 is transported by means of a transport unit 24 to a first aligning unit 100. By means of the first aligning unit 100 the notes of value of the stack of the notes of value are aligned in a preset alignment or at least the alignment of a part of the notes of value of the stack of notes of value is changed such that it approaches the preset alignment. By means of a transport unit 26 the aligned stack of notes of value is supplied to a separating unit 200 that separates the notes of value of the stack of notes of value and supplies the separated notes of value to a first sensor unit 300.

The first sensor unit 300 comprises an image detection unit by means of which from each supplied note of value at least one picture with an imaging of this note of value is taken. A control unit 28 of the device 10 determines in dependence of the imaging of the note of value in the picture at least one feature of the note of value and classifies the note of value in dependence of this feature in checks, banknotes of a preset currency and other sheet-like media. The other sheet-like media can for example be notes of value of another currency than the preset currency and/or other sheet-like media that were inserted by mistake by the user of the device, such as business cards or account statements. The preset currency is in particularly the currency that is to be handled by means of the device 10, in particular that is to be received in the value note cassettes 16*a* to 16*d*.

The notes of value that were classified neither as checks nor as banknotes of the preset currency are transported via a sorting gate 400 to a second intermediate storage 500 for intermediate storing of sheet-like media and are preferably stored intermediately in this, as a second stack of notes of value. The checks and the notes of value of the preset currency are however supplied to a second aligning unit 600 via the sorting gate 400. By means of this second aligning unit 600 the checks are aligned in a first preset target alignment and the banknotes are aligned in a second target alignment that is different from the first target alignment. In particular, several different target alignments for banknotes of different denominations are preset, and the second aligning unit 600 aligns the notes of value not only depending on whether they are checks or banknotes in different preset target alignments, but in addition also depending on the denomination of the banknotes.

The aligned notes of value are then supplied to a second sensor unit 29 by means of which the authenticity of the banknotes is determined and by means of which magnetic information of the checks are read out. The sensor unit 29 comprises a banknote sensor unit 29*a* by means of which the authenticity of the banknotes is checked, and a check sensor unit 29*b* by means of which the authenticity of the checks is checked and information printed on the checks are read out. The first sensor unit 300 and the second sensor unit 29 form together with the control unit 28 in particular a real money and check identification module. When determining the authenticity of the banknotes and/or checks preferably also information determined by means of the sensor unit 300 is taken into consideration.

Subsequently, the notes of value are transported by means of further transport elements, one of which is exemplarily identified with the reference number 30, in direction of a second sorting gate 700. Via the second sorting gate 700 all notes of value of the previously inserted stack of notes of value that have been classified as checks or banknotes of the preset currency, are firstly supplied to a first intermediate storage 32 and are intermediately stored in this. The intermediate storage 32 is in particular formed as a drum module, in which the notes of value to be received are received wound up between two foil tapes. After all notes of value of the inserted stack of notes of value have been received in the first intermediate storage 32 or the second intermediate storage 500, via a display unit 34 at least one information on the notes of value received in the first intermediate storage 32 and/or the in the second intermediate storage 500 is displayed to the user. This information comprises in particular information on the number of the inserted notes of value and/or the value of the sum of the denominations of the inserted notes of value that are received in the first intermediate storage 32. Further, the user is in particular requested to enter a confirmation information via an input unit 36.

If during a preset time interval after the request the user has not entered the confirmation information via the input unit 36 and/or if the user has entered a negative entry, the notes of value received in the first intermediate storage 32 are transported from this and are supplied to a stacking unit 40 by means of which a first stack of notes of value is formed from all notes of value received in the first intermediate storage 32. Further, the second stack of notes of value received in the second intermediate storage 500 is removed from the second intermediate storage 500. The first stack of notes of value as well as the second stack of notes of value is supplied to a stack combining unit 802 by means of which one single combined stack of notes of value is formed from the first and the second stack of notes of value. This combined stack of notes of value is subsequently output to the user via the input and output unit 20.

If the user however performs this input of the confirmation information upon request within the preset time interval, the second stack of notes of value is then removed from the second intermediate storage 500 and is output to the user via the input and output unit 20.

The notes of value that have been stored intermediately in the first intermediate storage 32 are however supplied to the safe 14 along a transport path 38 and are received in the value note cassettes 16*a* to 16*d*. The checks intermediately stored in the first intermediate storage 32 are, before being transported to the safe 40, invalidated by means of imprinting of an invalidation print image in a predetermined print area of the check. For this, between the second sorting gate 700 and the transport path 38 a printing unit 900 for imprinting of the checks is provided. Here, the checks are supplied to the printing unit 900 via the sorting gate 700 such that the print area on which the invalidation information is to be imprinted faces the print head of the printing unit 900, so that the print head can imprint the invalidation print image on this print area.

By means of the above-describe head module 12 it is achieved that in a device 10 checks and banknotes can be handled together and can be supplied in one stack to the device 10 mixed in any order. By this, an especially great ease of use is achieved for the user of the device 10, as the user does not have to manually presort the notes of values in checks and banknotes and does also not have to preset what kind of notes of value is supplied, as is the case with known devices.

After the notes of value of the inserted stack of notes of value have been separated by means of the separating unit 200 the notes of value are supplied individually to the sensor unit 300. An image detection unit of the sensor unit 300 takes at least one picture with an imaging of this note of value of each separated note of value. Depending on this imaging the control unit 38 classifies the notes of value in checks, admissible banknotes and other sheet-like media. By admissible banknotes banknotes are meant that belong to that currency that is handled by means of the device 10 and that is to be received in the cash boxes 16*a* to 16*d*.

The notes of value that have been classified as other sheet-like media are supplied to the second intermediate storage 500 via the sorting gate 400 and are intermediately stored in this until all notes of value of the inserted stack of notes of value have been received in the first intermediate storage 32 or in the second intermediate storage 500. Subsequently, these notes of value received in the second intermediate storage 500 are output again to the user of the device 10 via the input and output unit 20. In this way, a sorting of sheet-like media that do not represent admissible banknotes and checks is achieved. Further, via a control unit 28 depending on the image detected by means of the sensor unit 300 also damaged notes of value can be sorted out and be supplied to the second intermediate storage 500.

The notes of value classified as admissible banknotes and checks are supplied to the aligning unit 600 via the sorting gate 400 by means of which the checks are aligned in a first preset target alignment and the banknotes are aligned in a second preset target alignment that is different from the first target alignment. The first target alignment is preset such that the checks can be processed further by means of the units arranged downstream of the aligning unit 600. In particular, the first target alignment is preset such that the sensor unit 29*b* can read out magnetic information of a MICR section of the check and that the checks do not get jammed with elements of the device 10 during the further transport, so that a jamming of notes of value is avoided.

Accordingly, the second target alignment is preset such that the banknotes, if they are aligned in this second target alignment, can be subjected to an authenticity check by means of the sensor unit 29*a* and that also in case of the banknotes a jamming of notes of value is avoided.

In an alternative embodiment of the invention it can be the case that not all banknotes are aligned in the second target alignment but that further target alignments are preset, wherein the banknotes are aligned depending on their dimensions, in particular on their width, in the second target alignment or in one of these further preset target alignments. The width of the note of value is the dimension of that side of the note of value that during transport of the notes of value in the transport direction is directed transversely to the transport direction.

Figure 3:
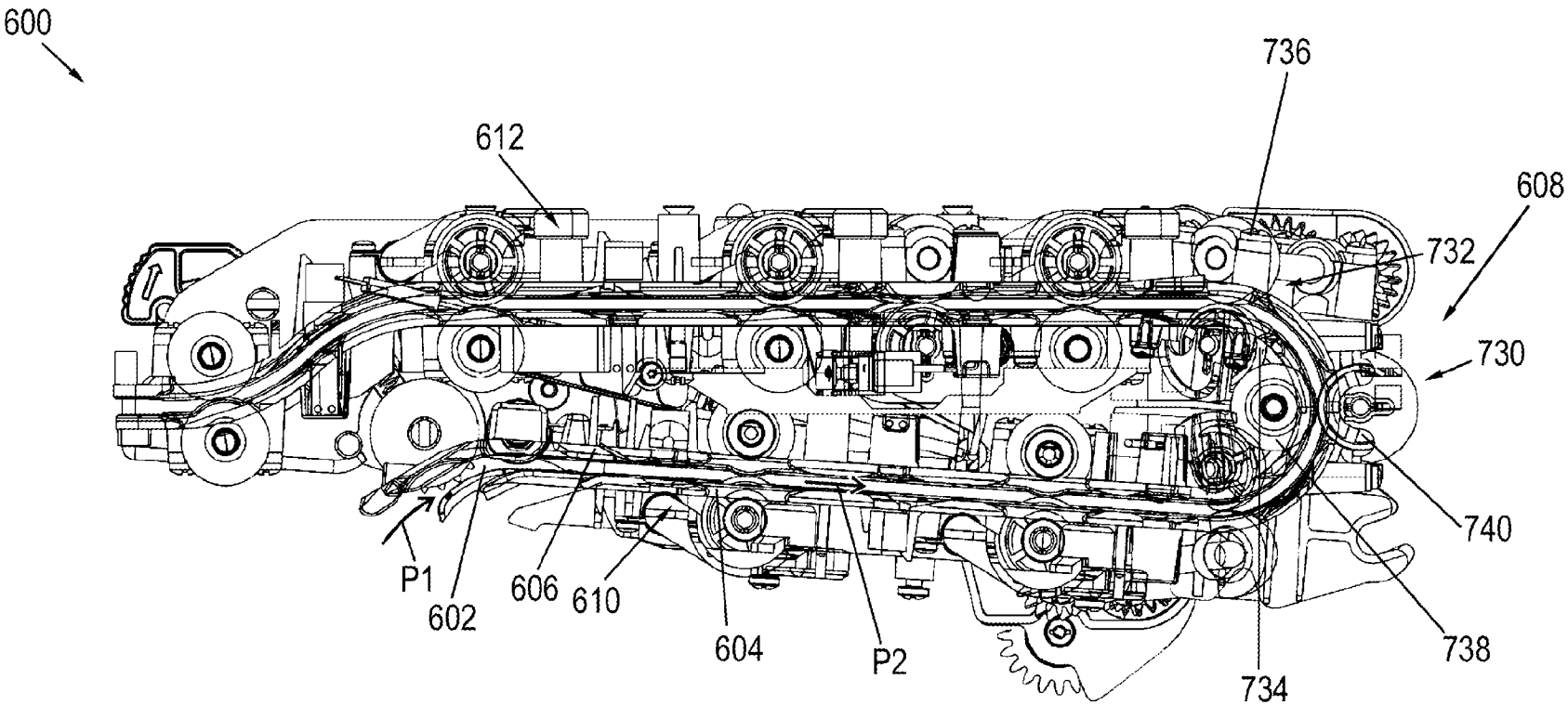
FIG. 3 is a side view of a cross-section of an aligning unit of the device according to FIGS. 1 and 2.
Figure 4:
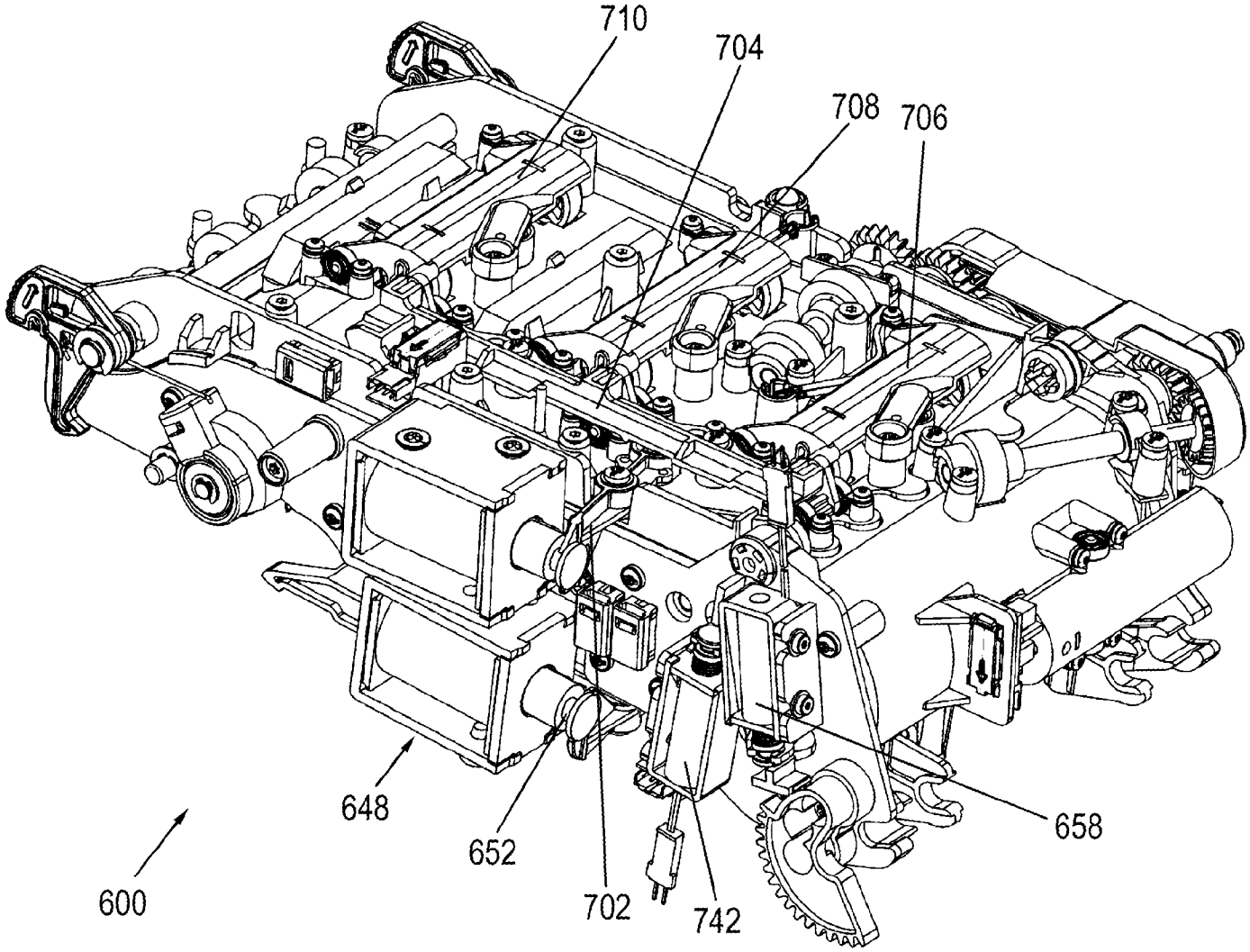
FIG. 4 is a schematic, perspective illustration of the aligning unit according to FIG. 3.

FIG. 3 is a side view of a sectional view of the aligning unit 600 according to FIG. 2. FIG. 4 is a schematic, perspective illustration of the aligning unit 600 according to FIG. 3.

The notes of value coming from the sorting gate 400 are supplied to the aligning unit 600 in direction of the arrow P1 and are transported through the aligning unit 600 along the transport path that is indicated by the dashed line 602 and during transport according to their respective type of note of value are aligned in the target alignment preset for this type of note of value. The transport direction in which the notes of value are transported along the transport path is indicated by the arrow P2. The transport path 602 is limited by a first partition unit 604 and a second partition unit 606, wherein the transport path 602 is arranged in the area formed between the two partition units 604, 606.

The two partition units 604, 606 are formed semi-circular in a curved portion 608, so that in this area the transport path 602 is also semi-circular, and the notes of value transported along the transport path 602 are diverted during their transport by means of the aligning unit 600 by 180°. By this, an especially compact and space-saving setup of the aligning unit 600 is achieved. In an alternative embodiment the partition units 604, 606 can also be designed such that they have no curved portion 608, but that during transport through the aligning unit 600 the notes of value are not diverted and are transported along a straight surface.

Figure 5:
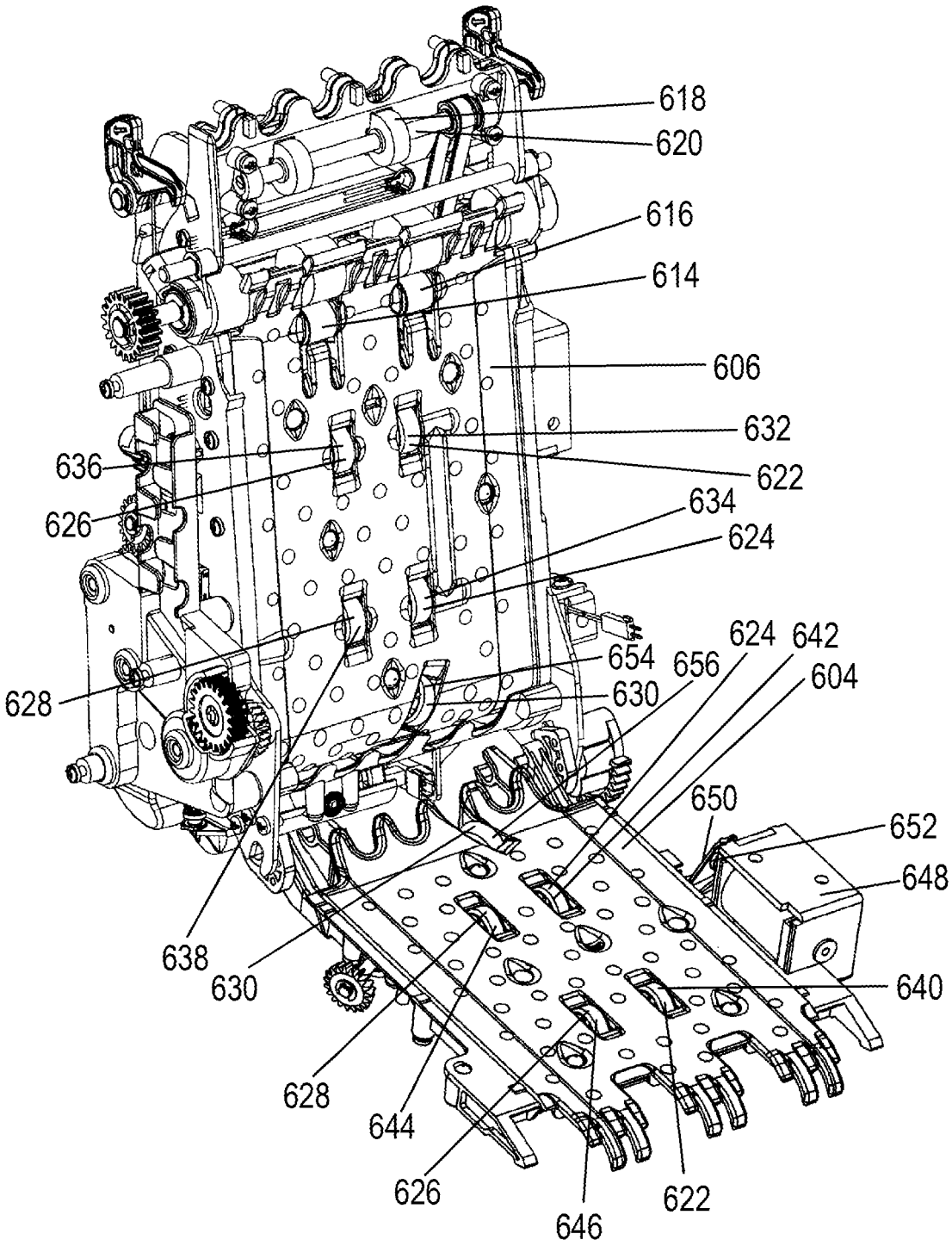
FIG. 5 is a schematic, perspective illustration of the aligning unit according to FIGS. 3 and 4 in an opened state with view to a first part of a transport path.

By means of diverting the notes of value the transport path 602 is divided into a first subarea 610 and a second subarea 612. In case of the schematic, perspective illustration of the aligning unit 600 shown in FIG. 5 in the first subarea 610 the partition element 604 is swiveled out of the residual aligning unit 600, so that the first part 610 of the transport path 602 is visible. In the transport direction P2 viewed at the beginning of the transport path 602 of the aligning unit 600 two rollers 614, 616 are arranged that are driven permanently via a central drive unit, so that they transport a note of value that it is in contact with them in transport direction P2. For this purpose, the rollers 214, 216 protrude into the transport path 602. By means of contact of the rollers 614, 616 directed in transport direction P2, the notes of value that are supplied to the aligning unit 600 coming from the sorting gate 400 are transported further in transport direction P2.

At the end of the transport path 602 of the notes of value also viewed in transport direction P2 within the aligning unit 600 two further rollers 618, 620 that are also permanently driven are arranged by means of which a note of value aligned by means of the aligning unit 600 is transported further in direction of the sensor unit 29.

In the first section five pairs of rollers 622 to 630 are arranged that each comprise two rollers that protrude into the transport path 602 through recesses of the partition unit 604, 606.

The rollers 632 to 638 of the pairs of rollers 622 to 628 are directed in transport direction P2 and are permanently driven via the central drive unit. The opposing rollers 640 to 646 of the pairs of rollers 622 to 628, however, serve as pressure rollers and are not driven. The mountings of the rollers 640 to 646 are connected to the armature 652 of a solenoid 658 via a connecting rod, wherein the rollers 640 to 646 can be swiveled between an activated operating mode and a deactivated operating mode. In the activated operating mode the rollers 640 to 646 press a note of value arranged in their area against the correspondingly driven rollers 632 to 636, so that the note of value is transported in transport direction P2 via the pairs of rollers 622 to 628. In the deactivated operating mode, however, the rollers 640 to 646 are swiveled away from the rollers 632 and 638 such that they do not press the note of value against the rollers 632 to 638 or respectively the pressing force is so little that by means of the pairs of rollers 622 to 628 no force is transmitted to the notes of value arranged between the rollers 632 to 638, 640 to 646 of the pairs of rollers 622 to 628.

The roller 654 of the pair of rollers 630 is also a pressure roller, whereas the roller 656 of the pair of rollers 630 is permanently driven via the central drive unit. Via the solenoid 658 the pressure roller 654 can be adjusted between an activated and deactivated operating mode. The pair of rollers 630 is aligned such that, if it is operated in the activated operating mode, it transports a note of value angularly to the transport direction P2 in direction of the arrow P3.

Figure 6:
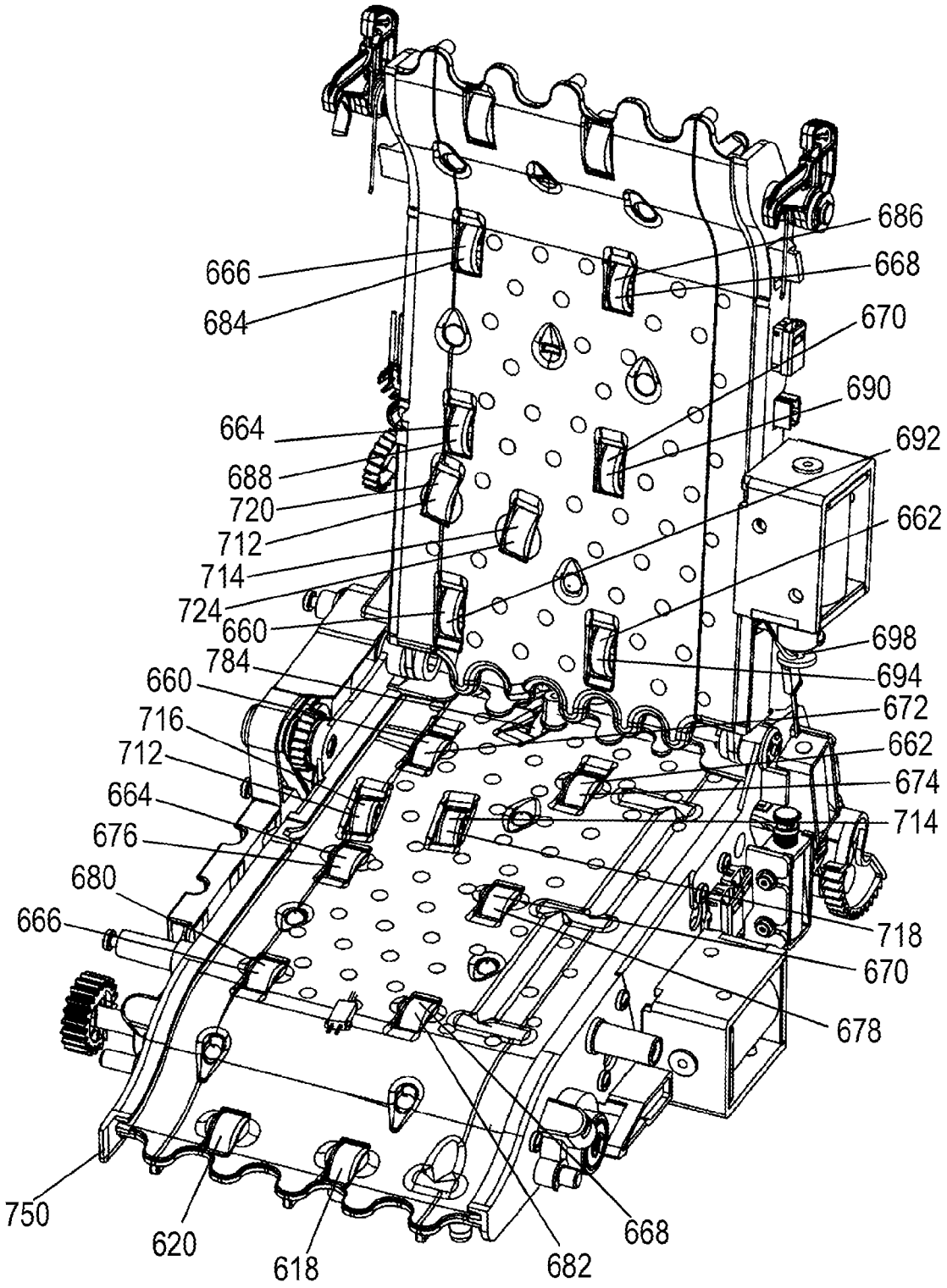
FIG. 6 is a schematic, perspective illustration of the aligning unit according to FIGS. 3 to 5 in an opened state with view to a second part of the transport path.

FIG. 6 is a schematic, perspective illustration of the aligning unit 600, wherein in the second subarea the partition unit 606 is swiveled away from the residual aligning unit 600, so that the transport path 602 is visible in this area. In the second subarea six pairs of rollers 660 to 670 are arranged that are directed in transport direction P2. Each of the pairs of rollers 660 to 670 comprises a permanently driven roller 672 to 682 as well as a not driven pressure roller 684 to 694. The pressure rollers 684 to 694 can be swiveled via the solenoid 696 between an activated and a deactivated operating state, wherein the armature 698 of the solenoid 696 is connected to support elements 706 to 710 of the pressure rollers 684 to 694 via a connecting element 702 and a connecting rod 704.

Further, two additional pairs of rollers 712, 714 protruding into the transport path 602 are provided, each of which comprises a driven roller 720, 724 and a pressure roller 716, 718 that can be adjusted between an activated and deactivated operating mode. The pairs of rollers 712, 714 are directed angularly to the transport direction P2, i.e. the force exerted on a note of value by the pairs of rollers 712, 714 is directed angularly to the transport direction P1, so that via them as well via the pair of rollers 630 a change in the alignment and/or position of a note of value transported along the transport path 602 is possible given a corresponding activation of the pairs of rollers 630, 712, 714. In the curved portion 608 two further pairs of rollers 730 and 732 are arranged, wherein the pair of rollers of these two pairs of rollers 730, 732 that is arranged upstream is directed in transport direction P2 and the other pair of rollers 732 is directed angularly to the transport direction P2.

The pair of rollers 730 comprises a permanently driven roller 738 as well as a not driven pressure roller 740 that can be adjusted between an activated operating mode and a deactivated operating mode by means of a solenoid that is not illustrated in FIGS. 3 to 6. The pair of rollers 732 also comprises a roller 736 that is permanently driven via the main drive and a not driven pressure roller 734 that can be adjusted between an activated operating mode and a deactivated operating mode by means of the solenoid 742.

In all above-described pairs of rollers the activated mode means in each case that, if a note of value is arranged between the rollers of a pair of rollers operated in the activated operating mode, this note of value is moved and/or rotated via the corresponding pair of rollers in the running direction of the rollers. In the deactivated mode, however, the pair of rollers exerts no force on a note of value arranged between the rollers of the pair of rollers or that this force is so little that it does not or at least only slightly change the alignment and/or position of the note of value.

Further, the aligning unit 600 comprises a lateral partition element 750 against which the notes of value to be aligned in the preset target positions, as is described below in connection with the FIGS. 7 to 16, are shifted.

Figure 7:
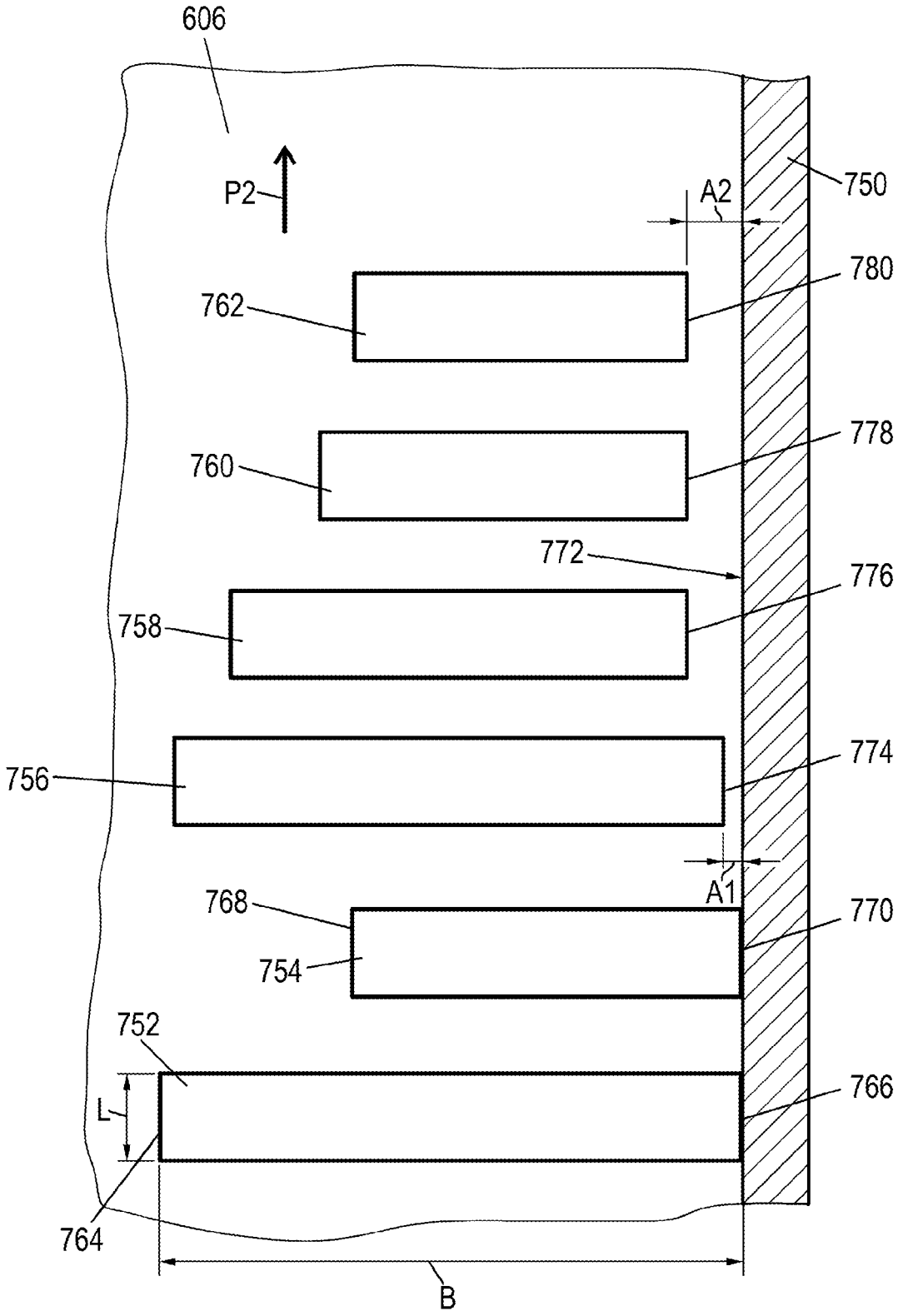
FIG. 7 is a schematic, illustration of several target alignments for several different notes of value.
Figure 8:
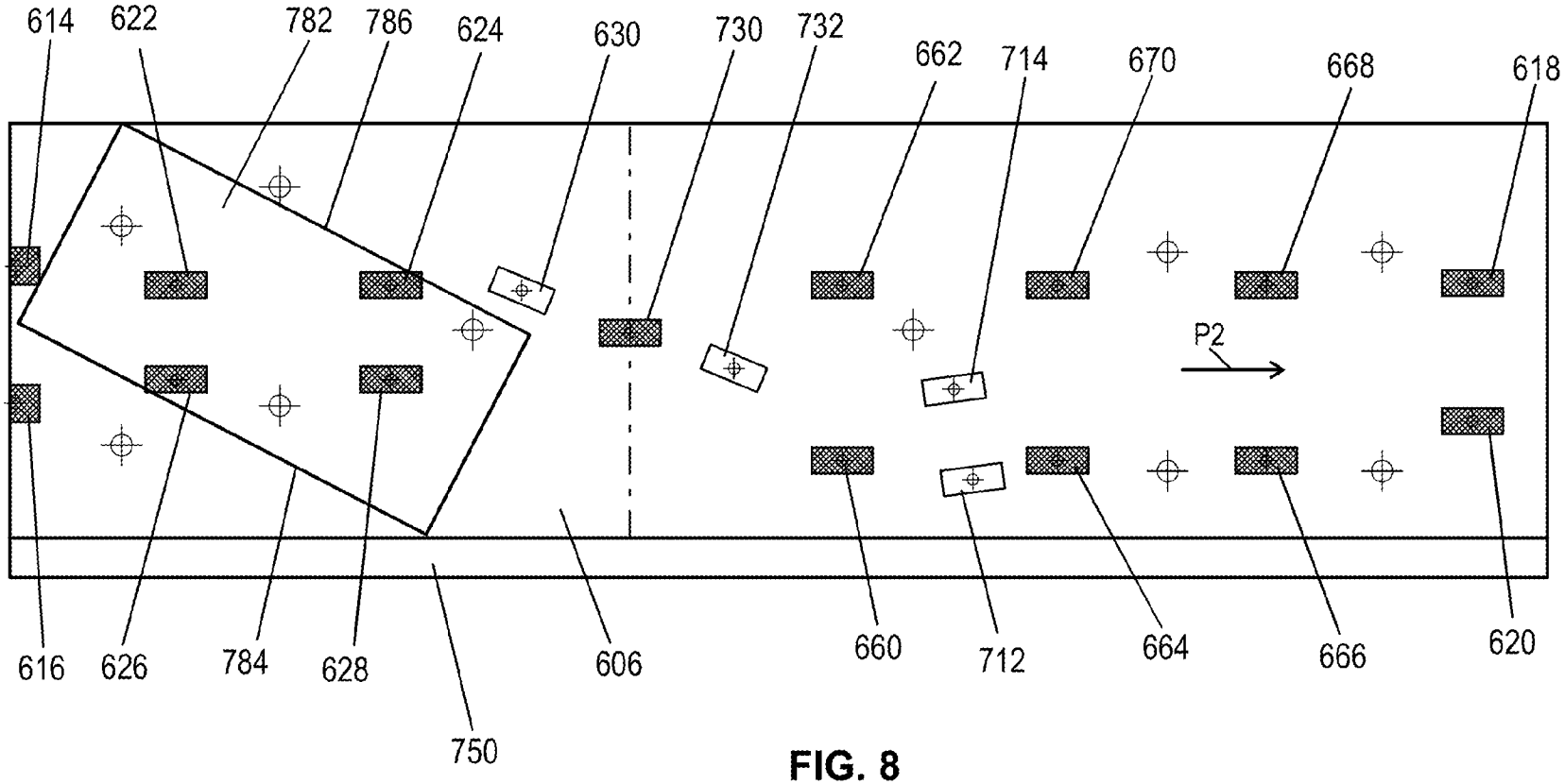
FIG. 8 is a schematic illustration of a note of value and the aligning unit when aligning this note of value during a first operating mode.

In FIG. 7 the lateral partition element 750 and several notes of value 752 to 756 aligned in different preset target alignments are illustrated. In order to simplify the illustration in their width the notes of value 752 to 756 are illustrated true to scale but in their length the notes of value are illustrated in a shortened form. In case of the note of value 752 for example the width is exemplarily identified with the reference sign B, the length is exemplarily identified with the reference sign L.

The notes of value 752, 754 are each checks, wherein the check 754 has a smaller width than the check 752. The checks 752, 754 are aligned in a preset first target alignment, wherein this first target alignment is preset such that the longer sides 764 to 770 of the checks 752 to 754 are directed parallel to the transport direction P2 and that in each case one of the longer sides 766, 770 rests against the partition element 750 and contacts a contact area 772 of the partition element 750.

The notes of value 756 to 762 are banknotes, wherein the banknote 756 which has the largest width of the four illustrated banknotes 756 to 762 is aligned in a preset second target alignment, and the other three banknotes 758 to 762 are aligned in a preset third target alignment. Also in case of the second and the third target alignments the longer sides of the banknotes 756 to 762 are directed parallel to the transport direction P2. In the second target alignment the longer side 774 of the banknote 756 that faces the partition element 750 has a preset distance A1 to the partition element 750. The third target alignment, however, is preset such that the longer sides 776 to 780 of the banknotes 758 to 762 facing the partition element 750 have a preset distance A2 to the partition element 750. In the present embodiment the distance A2 is greater than the distance A1.

By means of aligning the checks 752, 754 in the first target alignment and of the banknotes 756 to 762 in the second or the third target alignment it is achieved that the checks can be optimally processed further by means of the sensor unit 29*b*, in particular that all necessary information of the checks can be read out. Vice versa, by the second target alignment and the third target alignment it is guaranteed that the banknotes 756 to 762 can be checked for their respective authenticity and/or that the denominations can be determined. Thus, it is in particular sufficient that the sensor unit 29*a* comprises only a stripe reading unit, so that no expensive area reading unit is required.

In the following, in connection with FIGS. 8 to 16 step by step the procedure for aligning checks in the first target alignment and banknotes in the second target alignment is described. Here, in each case only a greatly simplified illustration of the aligning unit 600 is shown, wherein only one of the partition units 606 is illustrated and this is not curved, as shown in FIGS. 3 to 6, but planar. Further, for each pair of rollers only one roller is illustrated, wherein in the following embodiments no difference is made as to whether this is the driven roller or the not-driven roller. A difference is only made between the activated and the deactivated operating mode. Consequently, in FIGS. 8 to 16 the respective rollers are designated with the reference signs of the pairs of rollers. In FIGS. 8 to 16 those pairs of rollers that are each operated in the illustrated operating mode of the aligning unit 600 in the activated operating mode are each illustrated with points, whereas those pairs of rollers that are operated in the deactivated operating mode are illustrated without hatch.

In the FIGS. 8 to 13 different operating modes of the aligning unit 600 during aligning of a check 782 into the first target alignment are shown. In case of the first operating mode shown in FIG. 8 the check 782 is aligned in that actual alignment in which it was supplied coming from the sorting gate 400 via the rollers 614, 616 to the aligning unit 600. In this target alignment the longer sides 784, 786 are not directed parallel to the transport direction P2 and the longer side 784 facing the lateral partition element 750 does not contact the lateral partition element 750 over its entire length.

In the first operating mode, apart from the rollers 614 to 620 that are permanently driven in the activated operating mode, all pairs of rollers 622 to 628, 660 to 670, 730 that are directed in the transport direction P2, are operated in the activated operating mode. Thus, in this first operating mode the check 782 is moved in transport direction P2 without changing its alignment.

Figure 9:
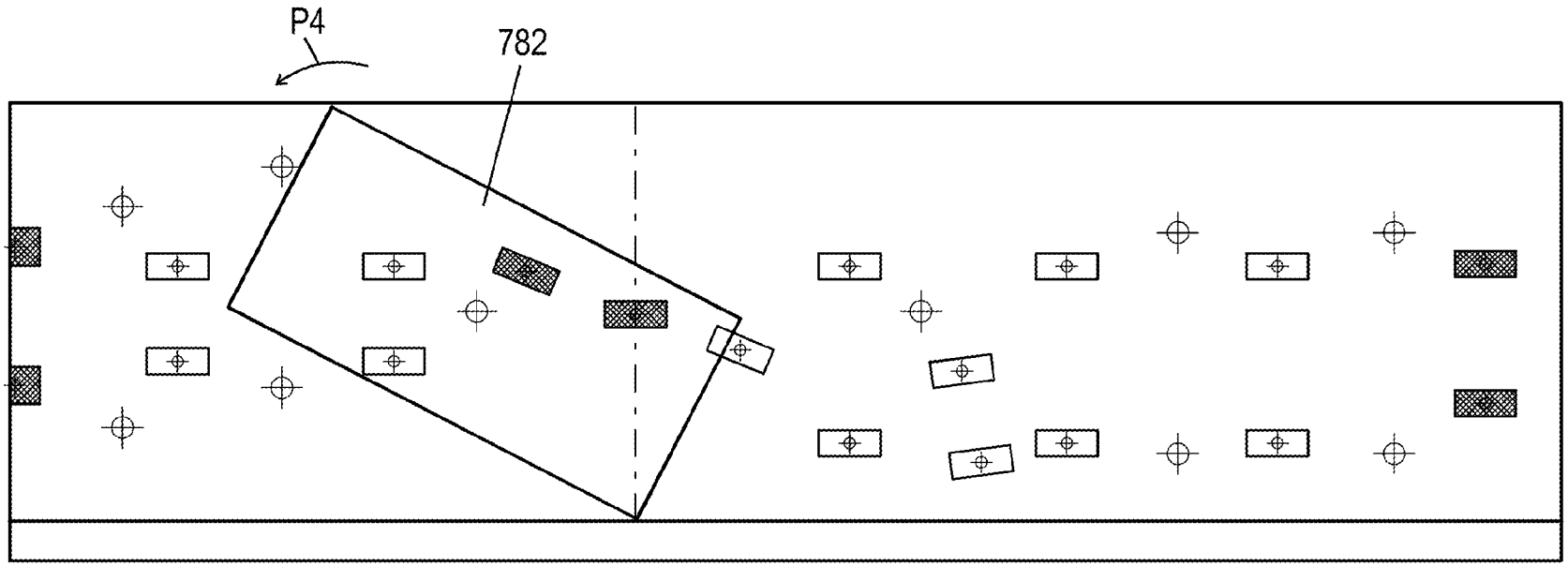
FIG. 9 is a schematic illustration of a note of value and the aligning unit when aligning this note of value in a second operating mode.

In the second operating mode shown in FIG. 9 the check 782 is transported as far in transport direction P2 that it contacts the pairs of rollers 730 and 630. In this second operating mode the pairs of rollers 622 to 628 and 660 to 670 that are directed in transport direction are operated in the deactivated operating mode, whereas only the pair of rollers 603 and the pair of rollers 730 are operated in the activated operating mode. By this, the check 782 is rotated in direction of the arrow P4, so that also the longer sides 784, 786 are rotated in direction of the arrow P4.

Figure 10:
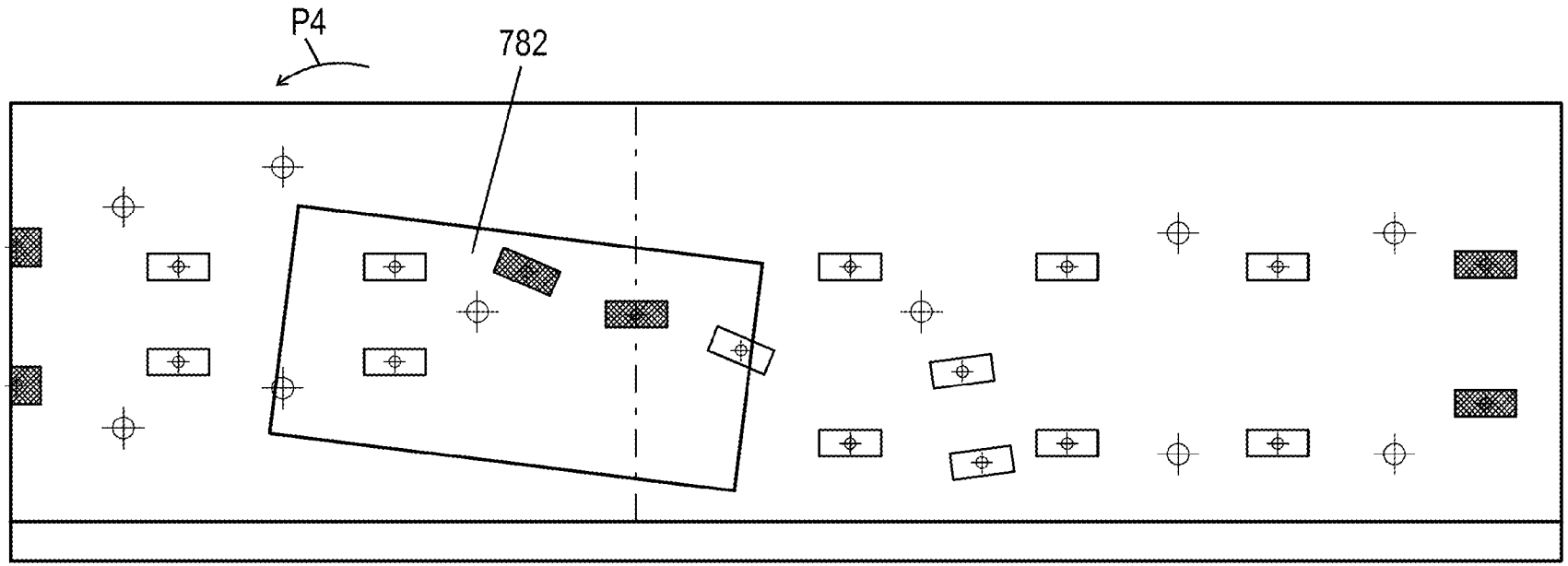
FIG. 10 is a schematic illustration of a note of value and the aligning unit during aligning of this note of value in a third operating mode.
Figure 11:
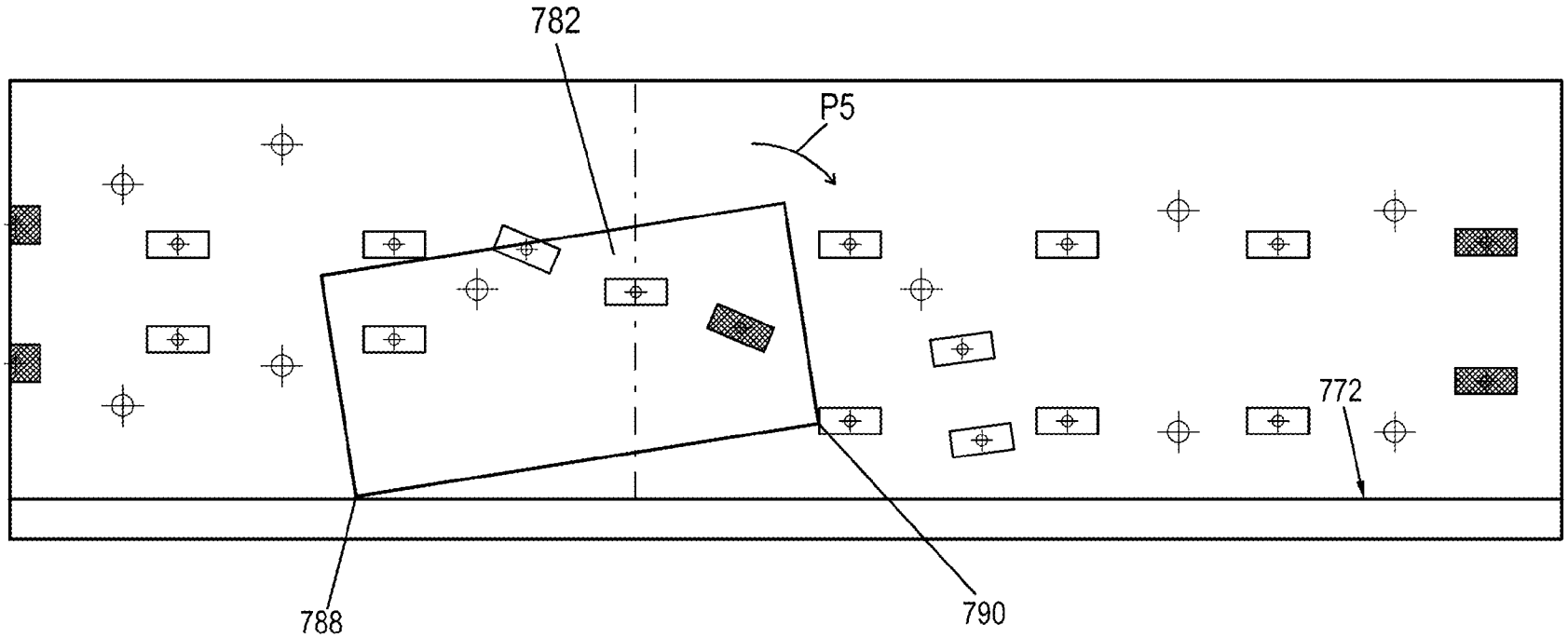
FIG. 11 is a schematic illustration of a note of value and the aligning unit during aligning of this note of value in a fourth operating mode.

In the third operating mode shown in FIG. 10 the check 782 has already been clearly rotated in direction of the arrow P4, so that its longer sides 784, 786 have already been aligned nearer to the target alignment, i.e. nearer to the alignment parallel to the transport direction P2. In the third operating mode as well only the pairs of rollers 630 and 730 are operated in the activated operating mode. Thus, the check 782 is rotated further in direction of the arrow P4 until it, as shown in FIG. 11 in the fourth operating mode, contacts with the corner 788 the lateral partition element 750. For this, the check 782 was rotated so far in direction of the arrow P4, that its longer sides 784, 786 are no longer, as has meanwhile been the case, aligned parallel to the transport direction P2, but compared to the actual alignment are directed in the opposite direction angularly to the transport direction P2.

In order to also move the corner 790 in direction of the lateral partition element 750, so that with its entire longer side 784 the check 782 rests against the contact area 772 of the lateral partition element 750, now the pair of rollers 732 is activated, whereas all other pairs of rollers 622 to 628, 660 to 670, 630, 730 that can be adjusted between the activated and the deactivated operating mode are operated in the deactivated operating mode. By this, the corner 790 of the check 782 is rotated in direction of the arrow P5 toward the lateral partition element 750.

Figure 12:
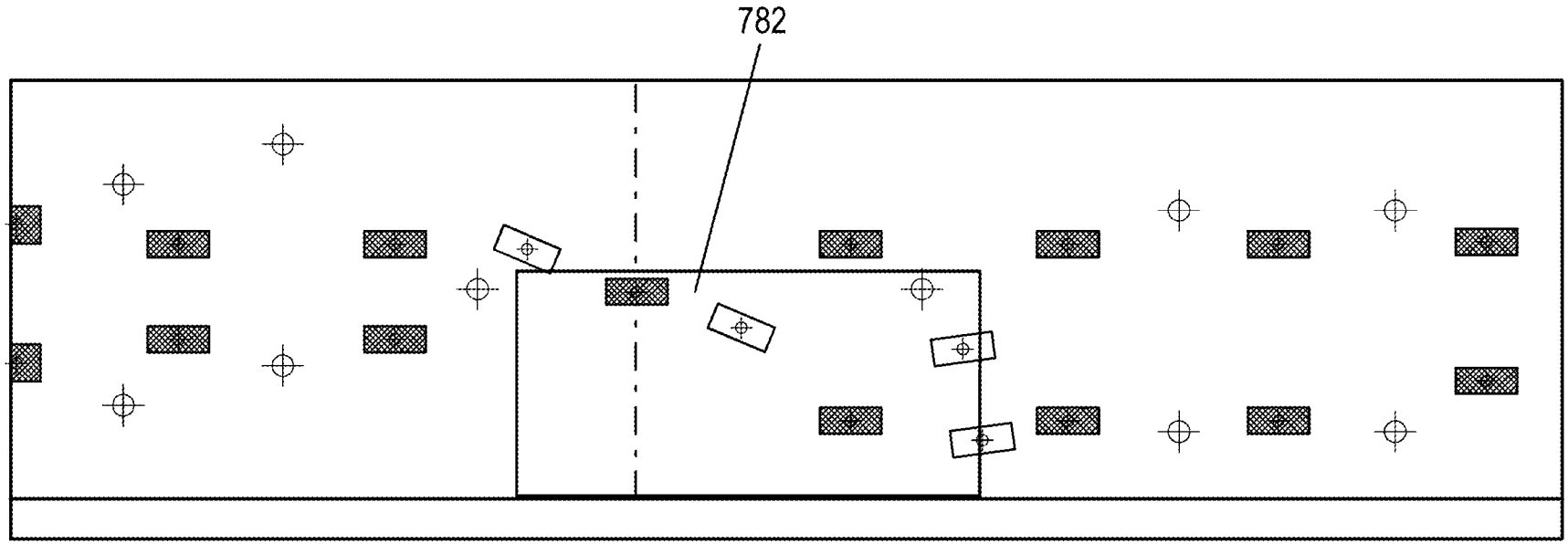
FIG. 12 is a schematic illustration of a note of value and the aligning unit during aligning of this note of value in a fifth operating mode.

In the fifth operating mode shown in FIG. 12 the check 782 was rotated by the pair or rollers 732 as far in direction of the arrow P5 that now its entire longer side 784 contacts the contact area 772 of the lateral partition element 750 and that now the check is aligned in the first target alignment.

As the first target alignment is that preset target alignment in which checks 782 are to remain, now all those pairs of rollers 622 to 628, 660 to 670, 730 that are directed in transport direction P2 are operated in the activated operating mode, and the pairs of rollers 630, 714, 712, 732 that are directed angularly to the transport direction P2 are operated in the deactivated operating mode, so that the check 782 is transported further in transport direction P2 without changing its direction. Thus, the check 782 remains in the first target alignment.

Figure 13:
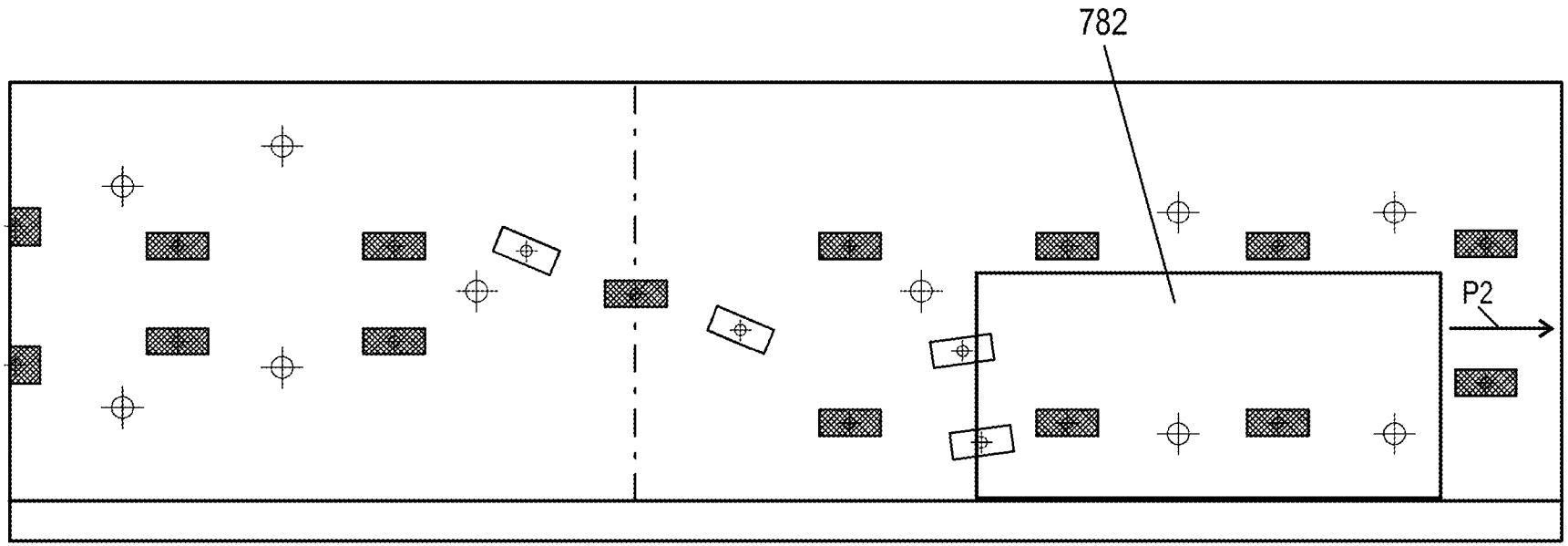
FIG. 13 is a schematic illustration of a note of value and the aligning unit during aligning of this note of value in a sixth operating mode.

In the sixth operating mode of the aligning unit 600 shown in FIG. 13 the check 782 has already been transported further in the transport direction P2 and is still aligned in the first target alignment. Still those pairs of rollers 622 to 628, 660 to 670, 730 that are directed in the transport direction P2 are operated in the activated operating mode, so that the note of value is transported further in the direction P2 and in the first target alignment is supplied to the sensor unit 29 that is arranged downstream of the aligning unit 600.

However, if not a check 782 but a banknote 791 coming from the first sorting gate 400 is supplied to the aligning unit 600, also this banknote 791, as is described in connection with the FIGS. 8 to 12, is aligned in the first target alignment. In particular, all notes of value supplied to the aligning unit 600 are at first aligned in the first target alignment, so that their alignment is easily adjustable by means of the lateral partition element 750 and then this is subsequently changed in further target alignments. Thus, in particular a simple control of the individual pairs of rollers of the aligning unit 600 is possible.

Figure 14:
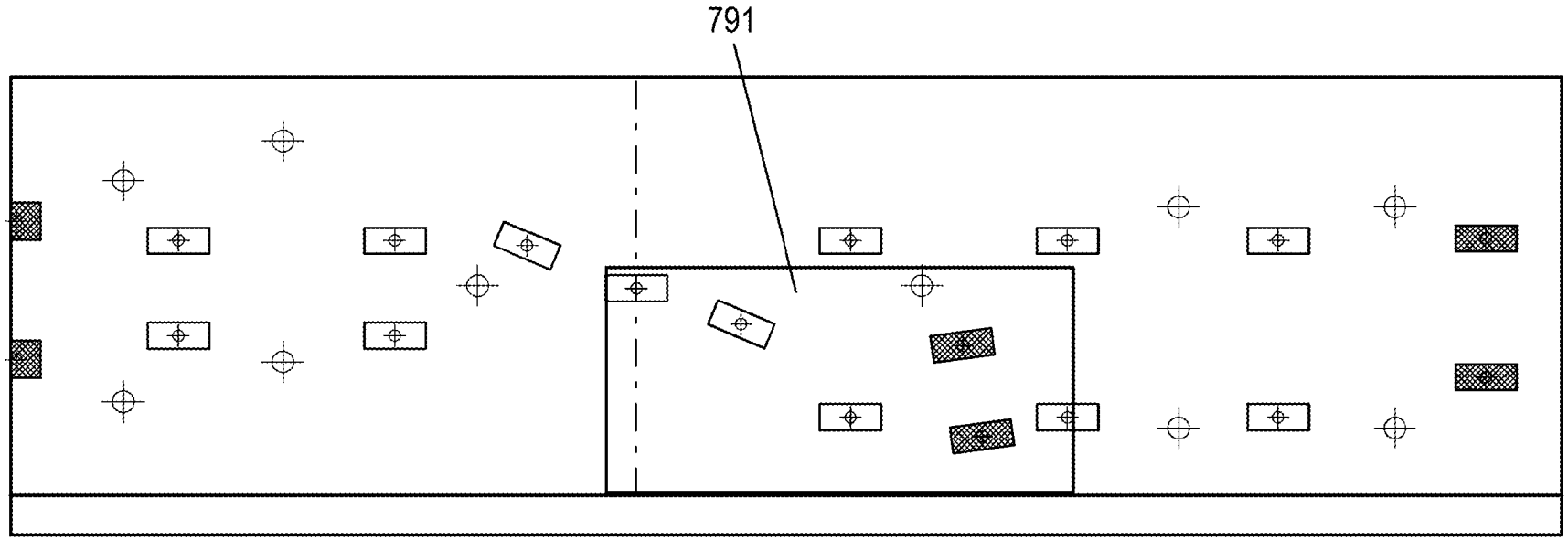
FIG. 14 is a schematic illustration of a note of value and the aligning unit during aligning of this note of value in a seventh operating mode.

After the banknote 791 has been aligned in the first target alignment, the pairs of rollers 712 and 714 are operated in the activated operating mode, as illustrated in the seventh operating mode in FIG. 14, whereas all other adjustable pairs of rollers 622 to 628, 660 to 670, 630, 730, 732 are operated in the deactivated operating mode. Via the pairs of rollers 712 and 714 that are arranged angularly to the transport direction P2, the banknote 791 is transported away from partition element 750 in direction of the arrow P6 angularly to the transport direction P2, whereas the longer sides 792, 794 remain parallel to the transport direction P2, so that only the distance between the longer side 794 facing the lateral partition element 750 and the contact area 772 of the partition element 750 is increased.

Figure 15:
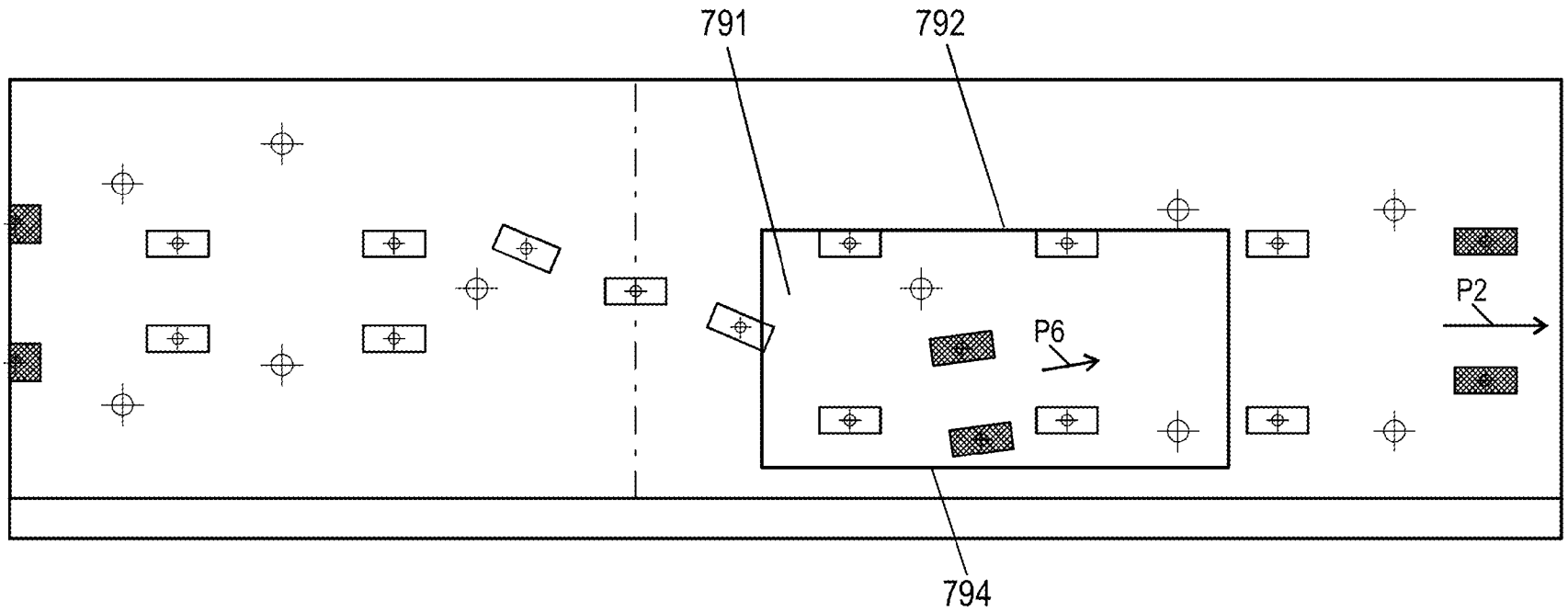
FIG. 15 is a schematic illustration of a note of value and the aligning unit during aligning of this note of value in an eighth operating mode.
Figure 16:
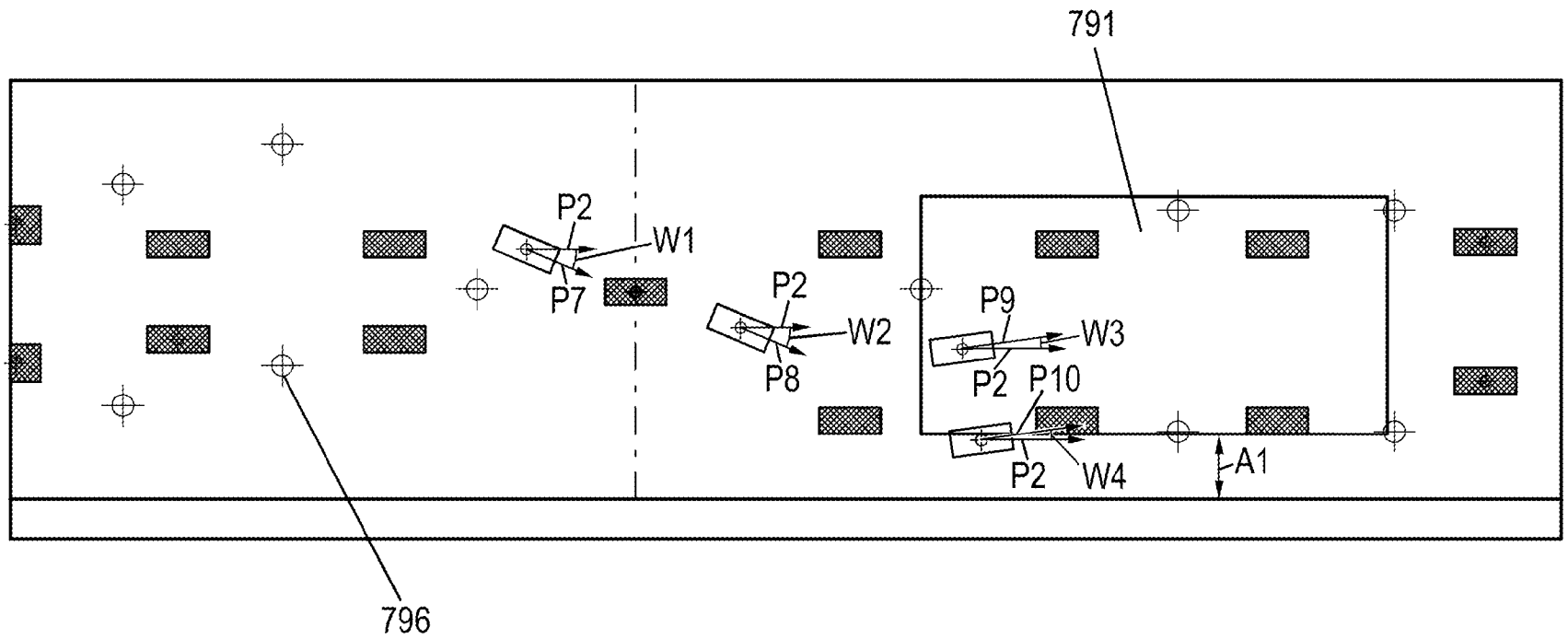
FIG. 16 is a schematic illustration of a note of value and the aligning unit during aligning of this note of value in a ninth operating mode.

In the eighth operating mode shown in FIG. 15 there is already a small distance between the partition element 750 and the longer side 794 of the banknote 791. As this distance is still smaller than the preset target distance A1 the pairs of rollers 712 and 714 are operated further in the activated operating mode, so that the banknote 791 is transported further in direction of the arrow P6 until it has, as illustrated in the ninth operating mode in FIG. 16, the preset target distance A1 to the contract area 772 of the lateral partition element 750. Subsequently, in the ninth operating mode all pairs of rollers 622 to 628, 660 to 670, 730 that are directed in transport direction P2 are operated in the activated operating mode, so that the banknote 791 is transported in the transport direction P2 without any change in its direction.

If the banknote is not to be aligned in the second target alignment but in the third target alignment, the pairs of rollers 712 and 714 are operated in the activated mode for a long period, so that they transport the banknote 791 as long in the direction P6, until the side 794 has the target distance A2 to the contact area 772.

In an alternative embodiment of the invention for transport of the notes of value 782, 791 in transport direction P2 it may be the case that not all pairs of rollers 622 to 628, 660 to 670, 630 that are directed in transport direction P2 are activated, but only the pairs of rollers 622 to 628, 660 to 670, 730 that are required for the further transport of the note of value 782, 791, i.e. those notes of value that are arranged downstream of the rear side of the note of value 782, 791 viewed in transport direction P2.

The actual alignment of the note of value when being supplied to the aligning unit 600 is in particular determined by means of the sensor unit 300. Depending on this, the points in time and lengths of time at which the individual pairs of rollers 622 to 630, 660 to 670, 712, 714, 730, 732 are to be operated in the activated or deactivated operating mode are determined. Further, determining the points in time and lengths of time can also be carried out depending on the light barriers arranged in the transport path one of which is exemplarily identified with the reference sign 796 in FIG. 16.

Further, via the lights barriers 796 also the respective alignment of the note of value 782, 791 can be verified, so that in case if the note of value 782, 791 has not been rotated and/or shifted as intended, the pairs of rollers 622 to 668, 630, 660 to 670, 712, 714, 730, 732 can be controlled correspondingly for adjusting this. In particular, the control of the pairs of rollers 622 to 668, 630, 660 to 670, 712, 714, 730, 732 is performed in form of a closed-loop control depending on the detection of notes of value via the light barriers 796. For this, in particular an actual alignment of a note of value 782, 791 after passing through the aligning unit 600 determined via the light barriers 796 is compared with the target alignment preset for the note of value 782, 791. Depending on the result of this comparison, the control of the pairs of rollers 622 to 668, 630, 660 to 670, 712, 714, 730, 732 for the alignment of a successive further note of value 782, 791 is adapted such that this will actually be aligned in the target alignment preset for it.

Alternatively and additionally the actual alignments determined by means of the light barriers 796 can also be used for a cascaded control of the pairs of rollers 622 to 668, 630, 660 to 670, 712, 714, 730, 732, wherein the pairs of rollers 622 to 668, 630, 660 to 670, 712, 714, 730, 732 that are each arranged downstream of a light barrier 796 are controlled in dependence of the actual alignment determined by means of this light barrier.

In an alternative embodiment the points in time and lengths of time for the pair of rollers 622 to 630, 730, 732 used for aligning the notes of value 782, 791 in the first target alignment can be fixedly preset, wherein in this case they are preset such that each note of value 782, 6791 supplied is aligned in the target alignment independent of its actual alignment.

The angle W1 between the running direction P7 of the pair of rollers 630 and the transport direction P2 has in particular a value between 20° and 30°, preferably of 25°. In the same way, the angle W2 between the running direction P8 of the pair or rollers 732 and the transport direction P2 has a value in the range between 20° and 30°, preferably an angle W2 of 25°. The pairs of rollers 712, 714 are aligned such that their running direction P9, P10 each has an angle W3, W4 to the transport direction P2 of 10° to 15°, in particular of 11°.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A method for handling notes of value comprising:

transporting notes of value in a transport direction along a transport path with a transport unit;

aligning the notes of value with an aligning unit;

controlling the aligning unit with a control unit;

identifying whether each one of the notes of value is a check or a banknote, and at least one dimension of each banknote, with a sensor unit arranged upstream of the aligning unit in the transport direction; and controlling the aligning unit with the control unit to align at least one check at a predetermined first target alignment align banknotes of a first width at a predetermined second target alignment, and align banknotes of a second width at a predetermined third target alignment; wherein each one of the first, second, and third target alignments are different.

2. The method of claim 1, further comprising controlling the aligning unit with the control unit to align the at least one check such that a long edge thereof is against a lateral partition element.

3. The method according to claim 1, wherein the aligning unit aligns a note of value to the first target alignment, if as an expression of the type of note of value the note of value is a check and that the aligning unit aligns a note of value to the second target alignment, if as an expression of the note of value the note of value is a banknote.

4. The method according to claim 1, wherein the transport path along which the notes of value are transported within the aligning unit is designed such that the notes of value are diverted by a preset angle, in particular by an angle in the range between 170° and 190°.

5. The method according to claim 1, wherein at first the aligning unit aligns all notes of value to the first target alignment and that the aligning unit, in each case depending on the determined expression of the feature of a note of value, keeps the note of value in the first target alignment and, without a change of the alignment in the first target alignment, transports the note of value further in transport direction, or aligns the note of value from the first target alignment to the at least one second target alignment.

6. The method according to claim 1, wherein the longer sides of the notes of value are directed parallel to the transport direction both in the first target alignment and in the second target alignment, preferably in case of all preset target alignments.

7. The method according to claim 1, wherein the aligning unit comprises at least one permanently driven first transport element that is directed in transport direction and that transports all notes of value supplied to the aligning unit in transport direction independent of the determined expression of the feature.

8. The method according to claim 1, wherein the aligning unit comprises at least one second transport element that is directed in transport direction that in an activated operating mode contacts a note of value to be aligned and changes at least one of the alignment and position of the note of value, and in a deactivated operating mode does not change the alignment and position of the note of value to be aligned, and that the control unit determines the operating mode of the second transport element depending on at least one of a determined actual alignment and actual position of the note of value to be aligned, in particular at least one of the point in time and the length of time at which or respectively during which the second transport element is operated in the activated operating mode.

9. The method according to claim 1, wherein the aligning unit comprises at least one third transport element directed angularly to the transport direction that in an activated operating mode contacts a note of value to be aligned and changes at least one of the alignment and position of the note of value, and in a deactivated operating mode does not change the alignment and position of the note of value to be orientated, and that the control unit determines the operating mode of the third transport element depending on at least one of a determined actual alignment of the note of value to be aligned and actual position of the note of value to be orientated, in particular at least one of the point in time and the length of time at which or respectively during which the third transport element is operated in the activated operating mode.

10. The method according to claim 9, wherein the third transport element is directed such that in the activated operating mode the third transport element at least one of transports and rotates the note of value in direction of a partition element, and that the control unit controls at least one of the third transport element and the second transport element such that in the first target alignment the note of value with one of its longer sides rests against a contact area of the partition element that is directed parallel to the transport direction.

11. The method according to claim 10, wherein the aligning unit comprises at least one fourth transport element that is directed in transport direction and arranged downstream of the third transport element, that in an activated operating mode contacts a note of value to be aligned and changes at least one of the alignment and position of the note of value, and in a deactivated operating mode does not change the alignment and position of the note of value to be aligned, that the aligning unit comprises at least one fifth transport element that is arranged downstream of the third transport element and directed angularly to the transport direction and away from the partition element that in an activated operating mode contacts a note of value to be aligned and transports the note of value away from the partition element and in a deactivated operating mode does not change the alignment and position of the note of value to be aligned, and in that the control unit determines the operating modes of at least one of the fourth transport element and of the fifth transport element depending on the intended target alignment for the note of value, in particular at least one of the point in time and the length of time at or respectively during which the fourth transport element or respectively the fifth transport element is operated in the activated operating mode.

12. The method according to claim 11, wherein after determining the first target alignment for a note of value the control unit operates the fourth transport element in the activated operating mode and the fifth transport element in the deactivated operating mode, and that the control unit operates the fifth transport element in the activated operating mode, if for a note of value a second target alignment is determined.

13. The method according to claim 10, wherein the first target alignment is preset such that a note of value that has been aligned in the first target alignment contacts the partition element and that the second target alignment is preset such that a note of value that has been arranged in the second target alignment has a preset distance to the partition element.

14. The method according to claim 1, wherein the aligning unit comprises at least one first sensor for determining at least one of the actual alignment and actual position of a note of value supplied to the aligning unit, at least one second sensor for determining at least one of the actual alignment or the actual position of a note of value during at least one of the alignment procedure or at least one third sensor for determining at least one of the actual alignment or the actual position of a note of value after the alignment procedure.

15. The method according to claim 14, wherein the control unit controls at least one of the first transport element, the second transport element, the third transport element, the fourth transport element, and the fifth transport element depending on the actual alignment determined by means of the first sensor, on the actual position determined by means of the first sensor, on the actual alignment determined by means of the second sensor, on the actual position determined by means of the second sensor, on the actual alignment determined by means of the third sensor, on the actual position determined by at least one of means of the third sensor and on the expression of the feature determined by means of the sensor unit.

* * * * *